US009177506B2

(12) United States Patent
Yamashita et al.

(10) Patent No.: US 9,177,506 B2
(45) **Date of Patent: *Nov. 3, 2015**

(54) DISPLAY APPARATUS, DRIVING METHOD THEREOF, AND ELECTRONIC SYSTEM

(71) Applicant: JOLED INC., Tokyo (JP)

(72) Inventors: Junichi Yamashita, Tokyo (JP); Katsuhide Uchino, Kanagawa (JP)

(73) Assignee: JOLED INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/566,846

(22) Filed: Dec. 11, 2014

(65) Prior Publication Data

US 2015/0097878 A1 Apr. 9, 2015

Related U.S. Application Data

(63) Continuation of application No. 14/175,310, filed on Feb. 7, 2014, now Pat. No. 8,947,327, which is a continuation of application No. 12/801,908, filed on Jul. 1, 2010, now abandoned, which is a continuation of application No. 12/071,228, filed on Feb. 19, 2008, now Pat. No. 7,764,251.

(30) Foreign Application Priority Data

Feb. 21, 2007 (JP) ..... 2007-041197

(51) Int. Cl.
*G09G 3/30* (2006.01)
*G09G 3/32* (2006.01)

(52) U.S. Cl.
CPC ..... *G09G 3/3233* (2013.01); *G09G 2300/0819* (2013.01); *G09G 2300/0852* (2013.01); *G09G 2310/0251* (2013.01); *G09G 2330/021* (2013.01)

(58) Field of Classification Search
CPC ..... G09G 3/2333; G09G 3/3258; G09G 2320/043; G09G 2320/0626; G09G 2320/021; G09G 2300/086; G09G 2300/0819; G09G 2300/0852
USPC ..... 345/76–83, 690; 315/169.1–169.3
See application file for complete search history.

(56) References Cited

U.S. PATENT DOCUMENTS 7,317,434 B2 1/2008 Lan et al.
7,429,985 B2 * 9/2008 Kimura et al. ..... 345/213

(Continued)

FOREIGN PATENT DOCUMENTS

JP 2003-173154 A 6/2003
JP 2003-255856 A 9/2003

(Continued)

OTHER PUBLICATIONS

Japanese Office Action issued Dec. 16, 2008 for corresponding Japanese Application No. 2007-041197.

*Primary Examiner* — Jennifer Nguyen
(74) *Attorney, Agent, or Firm* — Michael Best & Friedrich LLP

(57) ABSTRACT

A display apparatus includes: a pixel array section including a row of scanning lines, a column of signal lines, and pixels in a matrix, each of the pixels disposed at an intersection of both of the lines; and a drive section. The drive section performs line progressive scanning on the pixels. The pixel includes a light emitting device, a sampling transistor, a driving transistor, a switching transistor, and a holding capacitor. The sampling transistor samples a video signal in the holding capacitor, the driving transistor changes the device to a luminous state, the switching transistor becomes ON in advance of the sampling of the video signal to change the light emitting device to a non-luminous state, and the sampling transistor takes in the OFF voltage from the signal line to the driving transistor, thereby preventing a penetration current from flowing from the power source toward the fixed potential.

8 Claims, 11 Drawing Sheets

(56) References Cited

U.S. PATENT DOCUMENTS

| | | | | |
|---|---|---|---|---|
| 7,508,362 | B2 | 3/2009 | Ozawa et al. | |
| 7,646,363 | B2 | 1/2010 | Yamashita et al. | |
| 7,764,251 | B2 * | 7/2010 | Yamashita et al. | 345/76 |
| 7,777,698 | B2 * | 8/2010 | Takahara et al. | 345/76 |
| 8,004,481 | B2 * | 8/2011 | Yamazaki et al. | 345/82 |
| 8,947,327 | B2 * | 2/2015 | Yamashita et al. | 345/76 |
| 2003/0160745 | A1 | 8/2003 | Osame et al. | |
| 2005/0012686 | A1 | 1/2005 | Osame et al. | |
| 2005/0083270 | A1 | 4/2005 | Miyazawa | |
| 2005/0269959 | A1 | 12/2005 | Uchino et al. | |
| 2007/0222718 | A1 | 9/2007 | Takahara | |
| 2010/0271354 | A1 | 10/2010 | Yamashita et al. | |

FOREIGN PATENT DOCUMENTS

| | | | |
|---|---|---|---|
| JP | 2003-271095 | A | 9/2003 |
| JP | 2004-029247 | A | 1/2004 |
| JP | 2004-029791 | A | 1/2004 |
| JP | 2004-093682 | A | 3/2004 |
| JP | 2004-133240 | A | 4/2004 |
| JP | 2006-053539 | A | 2/2006 |
| JP | 2006-215213 | A | 8/2006 |

* cited by examiner

DISPLAY APPARATUS, DRIVING METHOD THEREOF, AND ELECTRONIC SYSTEM

CROSS REFERENCES TO RELATED APPLICATIONS

The present application is a continuation of U.S. patent application Ser. No. 14/175,310, filed Feb. 8, 2014, which is a continuation of U.S. patent application Ser. No. 12/801,908, filed Jul. 1, 2010, which is a continuation of U.S. patent application Ser. No. 12/071,228, filed on Feb. 19, 2008, now U.S. Pat. No. 7,764,251, issued on Jul. 27, 2010, which in turn claims priority from Japanese Application No.: 2007-041197, filed in the Japan Patent Office on Feb. 21, 2007. The entire contents of these applications are incorporated herein by reference.

BACKGROUND OF THE INVENTION

1. Field of the Invention

The present invention relates to a display apparatus in which pixels including light emitting devices are arranged in a matrix. More particularly, the present invention relates to a so-called active-matrix display apparatus in which the amount of a current flowing through a light emitting device, such as an organic EL device, etc., is controlled by an insulated-gate field effect transistor disposed in each pixel. Also, the present invention relates to a method of driving such a display apparatus, and an electronic system including such a display apparatus.

2. Description of the Related Art

In an image display apparatus, such as a liquid crystal display, for example, an image is displayed by arranging a large number of liquid crystal pixels in a matrix and controlling the transmission intensity or the reflection intensity of incident light for each pixel in accordance with image information to be displayed. This is the same for an organic EL display, etc., using an organic EL device as a pixel. However, the organic EL device is a self-emitting device unlike a liquid crystal pixel. Thus, the organic EL display has advantages of having high visibility of an image, unnecessary of back lighting, and high response speed compared with a liquid crystal display. Also, the luminance level (grayscale) of each light emitting device can be controlled by the amount of current flowing therethrough. The organic EL display is greatly different from a voltage-controlled type display, such as a liquid crystal display, in the point of being a so-called current-controlled type.

In the same manner as a liquid crystal display, for a driving method of an organic EL display, there are a simple matrix method and an active matrix method. The former has a simple structure, but has problems, such as it is difficult to achieve a large-scale and high-definition display.

Accordingly, active-matrix displays are currently being developed widely. In this method, a current flowing through a light emitting device in each pixel circuit is controlled by an active device (in general, a thin-film transistor: TFT) disposed in the pixel circuit. The descriptions thereof are disclosed in Japanese Unexamined Patent Application Publication Nos. 2003-255856, 2003-271095, 2004-133240, 2004-029791, 2004-093682, and 2006-215213.

SUMMARY OF THE INVENTION

A related-art pixel circuit is disposed at an intersection of a row of scanning lines supplying control signals and a column of signal lines supplying video signals, and includes at least a sampling transistor, a holding capacitor, a driving transistor, and a light emitting device. The sampling transistor becomes conductive in accordance with the control signal supplied from the scanning line, and samples the video signal supplied from the signal line. The holding capacitor holds an input voltage (signal voltage) in accordance with the sampled video signal. The driving transistor supplies an output current in accordance with the input voltage held by the holding capacitor during predetermined light emission period. In this regard, in general, the output current has a dependency on the carrier mobility and the threshold voltage of the channel region of the driving transistor. The light emitting device emits light at a luminance in accordance with the video signal by the output current supplied from the driving transistor.

The driving transistor receives the input voltage held by the holding capacitor at the gate, and allows the output current to flow between the source and the drain to apply the current to the light emitting device. In general, a luminance intensity of a light emitting device is in proportion to the amount of the flowing current. Furthermore, the amount of the supplied output current of the driving transistor is controlled by the gate voltage, that is to say, the input voltage written in the holding capacitor. In the related art pixel circuit, the amount of current supplied to the light emitting device is controlled by changing the input voltage applied to the gate of the driving transistor in accordance with the input video signal.

Here, the operation characteristic of a driving transistor is expressed by the characteristic expression:

$$Ids=(1/2)\mu(W/L)Cox(Vgs-Vth)^2$$

where Ids represents the drain current flowing between the source and drain, and is the output current supplied to the light emitting device in the pixel circuit. Vgs represents the gate voltage applied to the gate on the basis of the source, and is the above-described input voltage in the pixel circuit. Vth is a threshold voltage of the transistor. Also, μ represents the mobility of a semiconductor thin film constituting the channel of the transistor. In addition, W represents the channel width, L represents the channel length, and Cox represents the gate capacitance. As is apparent from the transistor characteristic expression, when a thin film transistor operates in the saturation region, if the gate voltage Vgs becomes grater than the threshold voltage Vth, the transistor goes into an ON state, and the drain current Ids flows. In principle, as shown by the above-described transistor characteristic expression, if the gate voltage Vgs is constant, the same amount of the drain current Ids is supplied to the light emitting device. Accordingly, if the video signal of the same level is supplied to each pixel constituting a screen, all the pixels emit light at the same luminance, and thus the uniformity of the screen should be obtained.

However, in reality, in a thin film transistor (TFT) constituted by a semiconductor thin film, such as a polysilicon, there are variations in individual device characteristics. In particular, the threshold voltage Vth is not constant, and varies for each pixel. As is apparent from the above-described transistor characteristic expression, if the threshold voltage Vth of each driving transistor varies, even if the gate voltage Vgs is constant, there arise variations in the drain current Ids, and thus the luminance varies for each pixel. Accordingly, the uniformity of the screen is lost. Up to date, pixel circuits including a function of canceling the variations in the threshold voltage of the driving transistors have been developed. For example, the above-described Japanese Unexamined Patent Application Publication No. 2004-133240 has disclosed such an example.

By pixel circuits including a function of canceling the variations of the threshold voltage, it is possible to improve the uniformity of the screen to a certain extent. However, the characteristic of a polysilicon thin-film transistor has also variations in the mobility μ for each device in addition to the threshold voltage Vth. As is apparent from the above-described transistor characteristic expression, when the mobility μ varies, even if the gate voltage Vgs is constant, there arise variations in the drain current Ids. As a result, the luminance intensity varies for each pixel, and thus the conformity of the screen is lost. Accordingly, up to date, display apparatuses including a function of canceling the variations in the mobility (mobility correction function) of the driving transistor have been developed in addition to a function of canceling the variations in the threshold voltage (threshold-voltage correction function) of the driving transistor. For example, the above-described Japanese Unexamined Patent Application Publication No. 2006-215213 has disclosed such an example.

In a related art active-matrix display apparatus using a light emitting device for a pixel, an image or a video is usually displayed by performing line progressive scanning (raster scanning) for each field or frame. In general, each field is divided into a luminous period and a non-luminous period. In the luminous period, each light emitting device is supplied with a driving current to emit light at a luminance in accordance with a video signal, whereas in a non-luminous period, the above-described threshold-voltage correction function and mobility correction function are performed. In this case, the screen luminance can be controlled by adjusting the ratio (duty) of a luminous period in one field.

In such a display apparatus, it is desirable to consume majority of power during a luminous period, and to restrain power consumption as much as possible during a non-luminous period. However, in the related art display apparatus, a penetration current flows through each pixel in relation to operations when a predetermined correction operation is performed in a non-luminous period. This penetration current does not contribute to the luminance, and thus a wasteful current is flowing. Accordingly, the related art display apparatus has a problem in that the power efficiency is low.

In view of the above-described problems of the related art, it is desirable to restrain a penetration current flowing during a non-luminous period in order to reduce power consumption of a display apparatus. According to an embodiment of the present invention, there is provided a display apparatus including: a pixel array section; and a drive section driving the pixel array section, wherein the pixel array section includes a row of first scanning lines and second scanning lines, a column of signal lines, and pixels in a matrix, each of the pixels disposed at an intersection of each of the first scanning lines and each of the signal lines, the drive section outputs control signals to the row of first scanning lines and second scanning lines, respectively, to perform line progressive scanning on the pixels for each row, and supplies a signal potential and a predetermined off potential to a column of signal lines in synchronism with the line progressive scanning, the pixel includes a light emitting device, a sampling transistor, a driving transistor, a switching transistor, and a holding capacitor, the sampling transistor has a control terminal connected to the first scanning line and a pair of current terminals, one of the current terminals is connected to the signal line, and the other of the current terminals is connected to a control terminal of the driving transistor, the driving transistor has a pair of current terminals, one of the current terminals is connected to a power source, and the other of the current terminals is connected to the light emitting device, the switching transistor has a control terminal connected to the second scanning line and a pair of current terminals, one of the current terminals is connected to a fixed potential, and the other of the current terminals is connected to the other of the current terminals of the driving transistor, and the holding capacitor has one terminal connected to the control terminal of the driving transistor and the other terminal connected to the other of the current terminals of the switching transistor, wherein the sampling transistor passes a current in accordance with the control signal supplied from the first scanning line, and samples a signal potential of a video signal supplied from the signal line to hold the signal potential in the holding capacitor, the driving transistor allows a drive current to flow through the light emitting device to change the device to a luminous state in accordance with the held signal potential supplied by the current from the power source, the switching transistor becomes ON in accordance with the control signal supplied from the second scanning signal in advance of the sampling of the video signal to connect the other terminal of the holding capacitor to a fixed potential to change the light emitting device to a non-luminous state, and the sampling transistor becomes ON in accordance with the other control signal supplied from the first scanning line when the switching transistor becomes ON, and takes in the OFF voltage from the signal line to apply the voltage to the control terminal of the driving transistor, thereby preventing a penetration current from flowing from the power source toward the fixed potential.

In the above-described embodiment, the sampling transistor may become ON in accordance with the control signal supplied from the first scanning line at the time of the signal line being a predetermined reference potential after turning OFF the driving transistor, may write the reference potential to the control terminal of the driving transistor, thereby setting a potential difference between both ends of the holding capacitor to a higher value than a threshold voltage of the driving transistor, and the sampling transistor may turn OFF the switching transistor next, may charge the holding capacitor until the driving transistor is cutoff, thereby holding a voltage corresponding to the threshold voltage in the holding capacitor. Also, the driving transistor may negatively feed back the drive current flowing through the driving transistor to the holding capacitor for a predetermined correction time period in a state of the signal voltage being applied to the control terminal thereof, thereby applying a correction in accordance with a mobility of the driving transistor to the signal potential held by the holding capacitor.

By the present invention, when the display apparatus moves from a luminous period to a non-luminous period, the switching transistor is turned ON to connect the output current terminal (source) of the driving transistor to a fixed potential, thereby cutting off the light emitting device. Thus, the drive current is stopped flowing through the light emitting device to change the device to a non-emission state. When the light emitting device has been in the non-luminous period, each pixel performs a predetermined correction operation. However, if this state continues without change, the drive current flows to the fixed potential through the driving transistor. Thus, in the present invention, when the switching transistor is turned ON to go into the non-luminous period, the sampling transistor is turned ON to get an OFF voltage from the signal line to apply the voltage to the control terminal (gate) of the driving transistor. Thereby, the driving transistor is turned OFF. Accordingly, it is possible to block a penetration current flowing from the power source to the fixed potential. In this manner, by cutting off the driving transistor at the time of going into the non-luminous period, it is possible to eliminate a penetration current, thereby reducing the power consumption of the panel.

DESCRIPTION OF THE PREFERRED EMBODIMENTS

Figure 1:
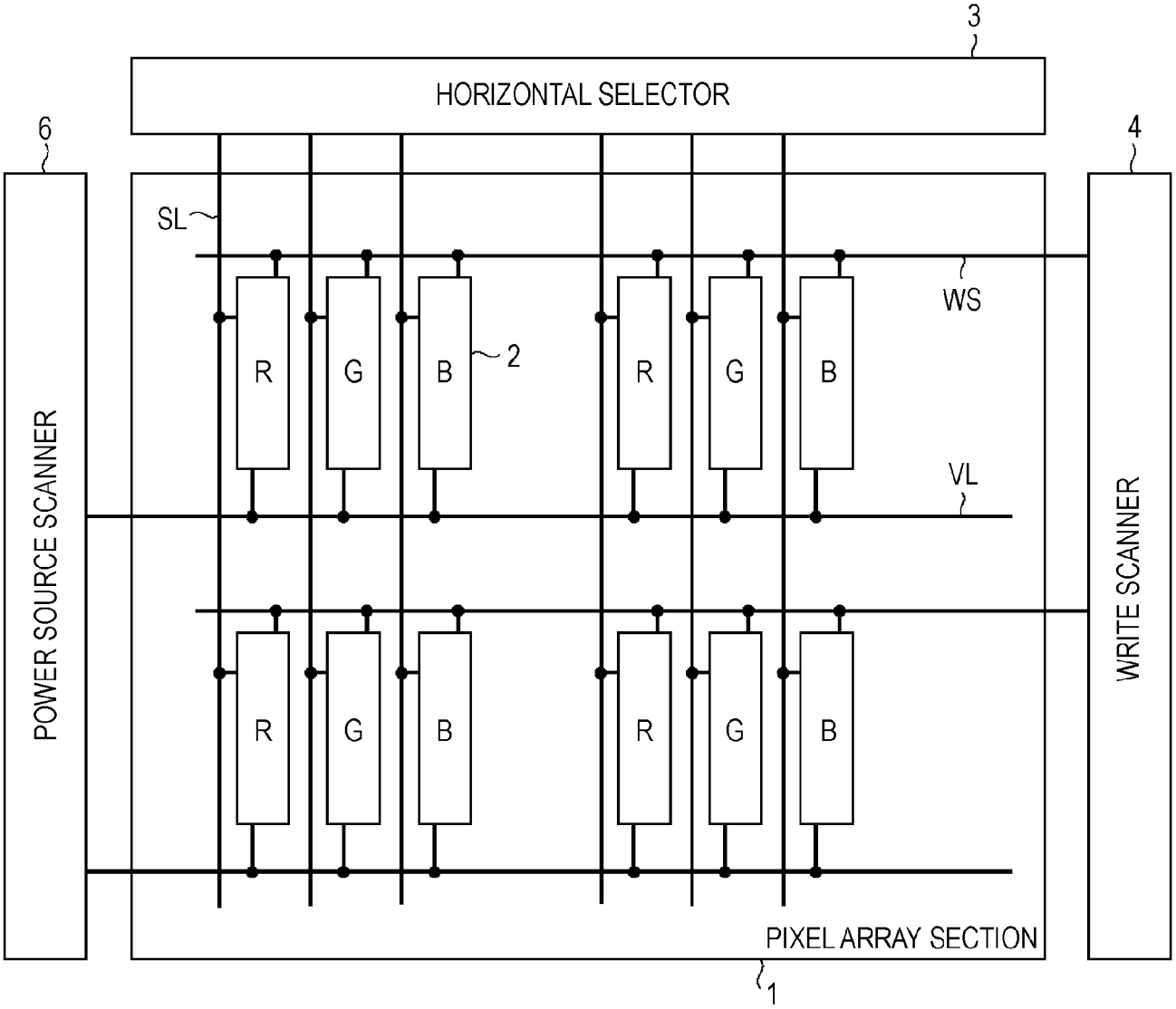
FIG. 1 is a block diagram illustrating an overall configuration of a display apparatus according to the related art.

In the following, a detailed description will be given of the present invention with reference to the drawings. First, in order to make clear the background of the present invention, a description will be given of a display apparatus according to related art with reference to FIG. 1. The present invention is based on this example of the related-art developments, and thus a description will be given of the example of the related-art developments as part of the present invention. FIG. 1 is a block diagram illustrating an overall configuration of a display apparatus according to the related art. As shown in the figure, this display apparatus includes a pixel array section 1 and a drive section driving the pixel array section 1. The pixel array section 1 includes a row of scanning lines WS, a column of signal lines SL, and pixels 2, in a matrix, disposed at intersections of both of the lines, and power supply lines (power source lines) VL disposed corresponding to individual rows of individual pixels 2. In this regard, in this example, any one the RGB three primary colors is assigned to each pixel 2, and thus color display is possible. However, the present invention is not limited to this, and includes a monochrome display device. The drive section includes a write scanner 4 which supplies a control signal to each scanning line WS in sequence to perform line progressive scanning on pixels 2 for each row, a power source scanner 6 which supplies a power voltage changing between a first voltage and a second voltage to each power supply line VL in accordance with the line progressive scanning, and a signal selector (horizontal selector) 3 which supplies a signal potential to be a video signal and a reference potential to the column of signal lines SL in accordance with the line progressive scanning.

Figure 2:
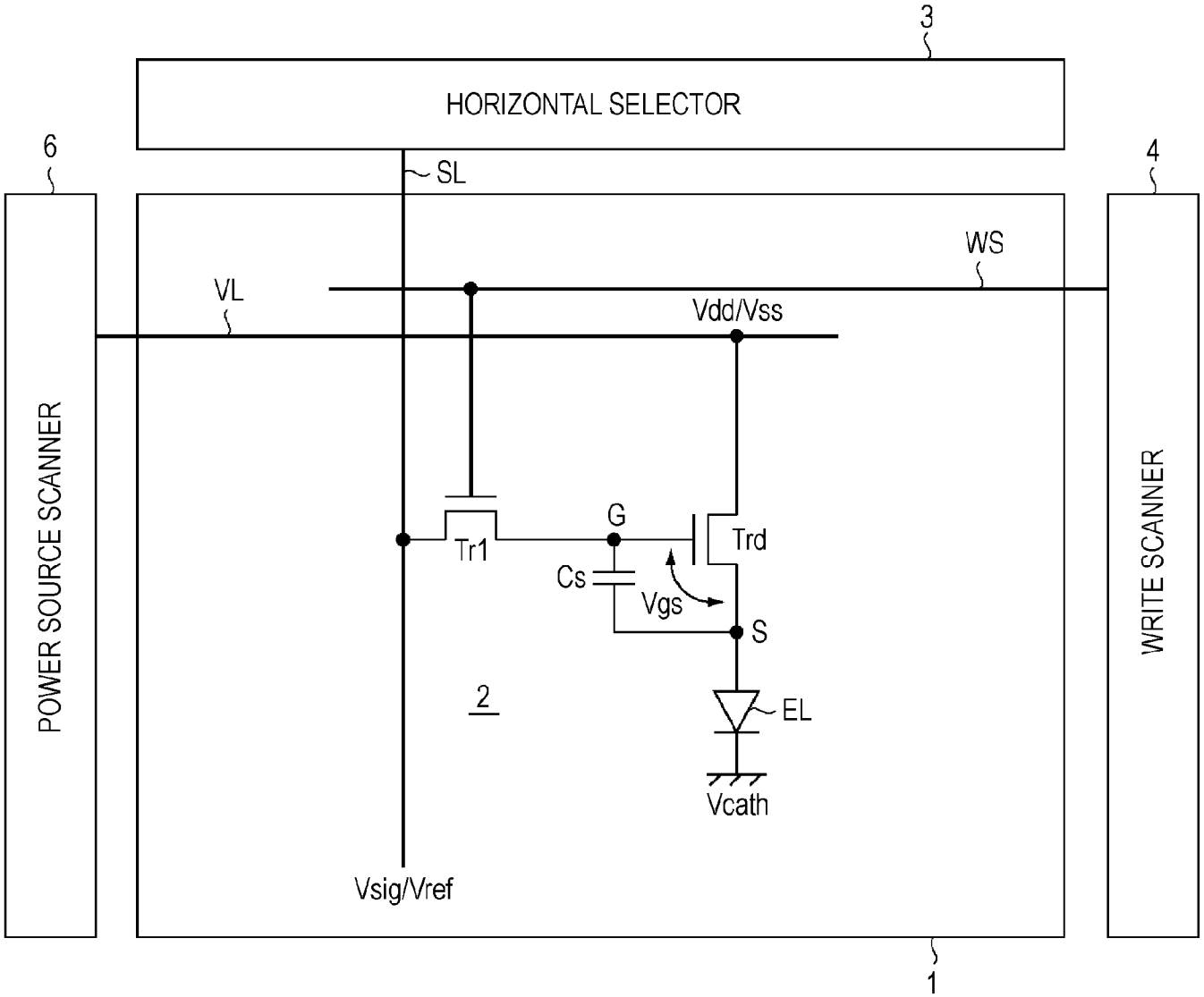
FIG. 2 is a circuit diagram illustrating a configuration of a pixel included in the display apparatus shown in FIG. 1.

FIG. 2 is a circuit diagram illustrating a specific configuration of the pixel 2 and a wiring relationship included in the display apparatus shown in FIG. 1. As shown in the figure, the pixel 2 includes a light emitting device EL typified by an organic EL device, etc., a sampling transistor Tr1, a driving transistor Trd, and a holding capacitor Cs. The sampling transistor Tr1 has a control terminal (gate) connected to the corresponding scanning line WS and a pair of current terminals (source and drain), one of the current terminals is connected to the corresponding signal line SL, and the other of the current terminals is connected to a control terminal (gate G) of the driving transistor Trd. The driving transistor Trd has a pair of current terminals, one of the current terminals (source and drain) is connected to the light emitting device EL, and the other of the current terminals is connected to the power supply line VL. In this example, the driving transistor Trd is an N-channel type, and the drain thereof is connected to the power supply line VL, and the source is connected to the anode of the light emitting device EL as an output node. The cathode of the light emitting device EL is connected to a predetermined cathode potential Vcath. The holding capacitor Cs is connected across the source S and the gate G of the driving transistor Trd.

In such a configuration, the sampling transistor Tr1 passes a current in accordance with the control signal supplied from the scanning line WS, and samples a signal potential supplied from the signal line SL to hold the signal potential in the holding capacitor Cs. The driving transistor Trd receives the supply of a current from the power supply line VL at the first potential (high potential Vdd), and causes the drive current to flow to the light emitting device EL in accordance with the signal potential held in the holding capacitor Cs. In order to cause the sampling transistor Tr1 to be conductive in a time period in which the signal line SL is at the signal potential, the write scanner 4 outputs a control signal having a predetermined pulse width to the control line WS, thereby holding the holding capacitor Cs at the signal potential and adds correction on the mobility μ of the driving transistor Trd at the same time. After this, the driving transistor Trd supplies a drive current according to the signal potential Vsig written in the holding capacitor Cs to the light emitting device EL to perform a light emitting operation.

The pixel circuit 2 includes a function of correcting a threshold voltage in addition to above-described function of correcting mobility. That is to say, before the sampling transistor Tr1 samples the signal potential Vsig, the power source scanner 6 changes the power supply line VL from a first potential (high potential Vdd) to a second potential (low potential Vss) at first timing. Also, before the sampling transistor Tr1 samples the signal potential Vsig, the write scanner 4 makes the sampling transistor Tr1 conductive at second timing to apply a reference voltage Vref from the signal line SL to the gate G of the driving transistor Trd and sets the source S of the driving transistor Trd to a second potential (Vss). The power source scanner 6 changes the power supply line VL from the second potential Vss to the first potential Vdd at third timing after the second timing, and holds the voltage corresponding to the threshold voltage Vth of the driving transistor Trd in the holding capacitor Cs. By such a function of correcting a threshold voltage, in the present display apparatus, it is possible to cancel the influence of the threshold voltage Vth of the driving transistor Trd, which varies for each pixel.

The pixel circuit 2 further includes a bootstrap function. That is to say, the write scanner 4 releases the application of the control signal to the scanning line WS at the stage of the signal potential Vsig having been held in the holding capacitor Cs, and makes the sampling transistor Tr1 non-conductive, cuts off the gate G of the driving transistor Trd electrically from the signal line SL, thereby linking the potential of the gate G with the potential variations of the source S of the driving transistor Trd. Accordingly, it is possible to maintain the voltage Vgs across the gate G and the source S at a constant.

Figure 3:
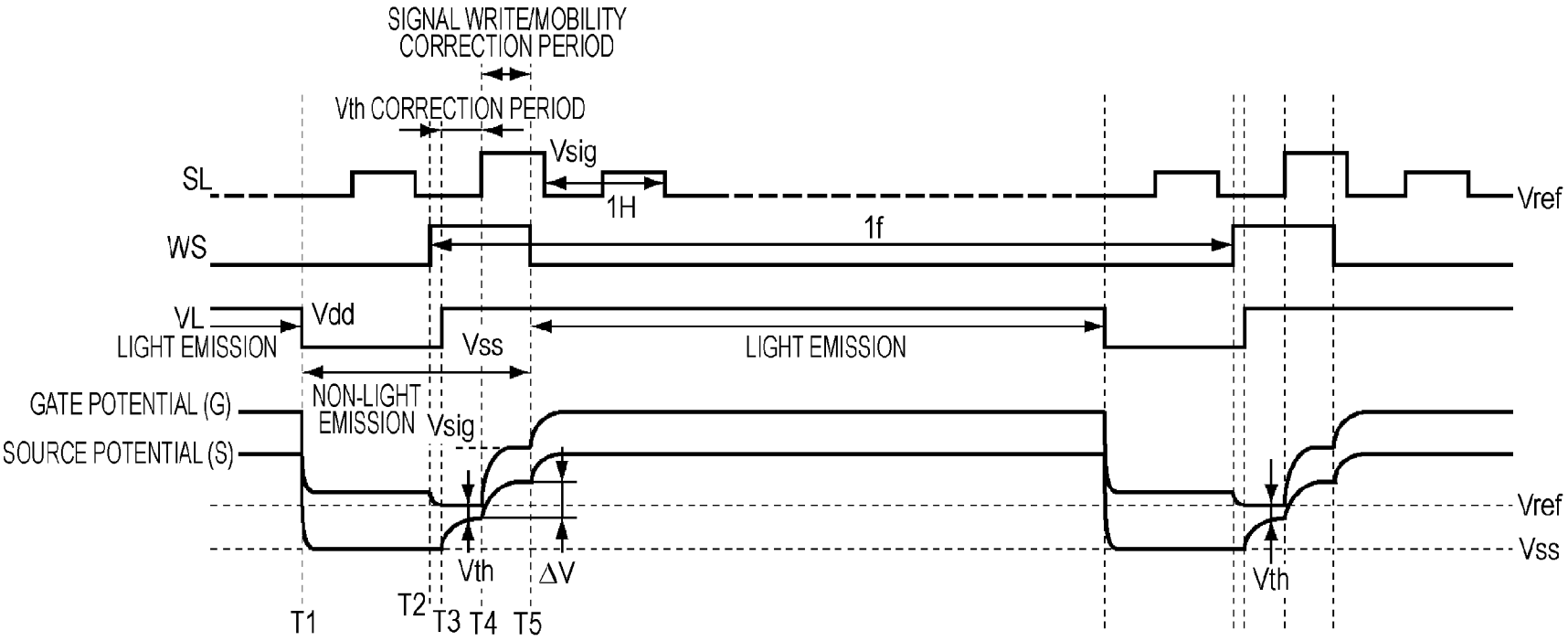
FIG. 3 is a timing chart to be used for explaining operations of the display apparatus, shown in FIG. 2, according to related art.

FIG. 3 is a timing chart to be used for explaining operations of the pixel circuit 2 shown in FIG. 2. The chart shows a change in the potential of the scanning line WS, a change in the potential of the power supply line VL, and a change in the potential of the signal line SL on a common time axis. Also, the chart shows the changes in the potentials of the gate G and the source S of the driving transistor in parallel with the changes in these potentials.

As described above, the control signal pulse is applied to the scanning line WS in order to turn ON the sampling transistor Tr1. The control signal pulse is applied to the scanning line WS in accordance with the line progressive scanning of the pixel array section on a cycle of one field (1*f*). The power source line VL changes between the high potential Vdd and the low potential Vss on a cycle of one field in the same manner. The video signal, which changes between the signal potential Vsig and the reference potential Vref in one horizontal cycle (1H), is supplied to the signal line SL.

As shown by the timing chart in FIG. 3, the pixel enters the non-luminous period of the field from the luminous period of the previous field, and then becomes the luminous period of the field. In this luminous period, a preparatory operation, a threshold voltage correction operation, a signal write operation, a mobility correction operation, and the like are performed.

In the luminous period of the previous field, the power supply line VL is at the high voltage Vdd, and the driving transistor Trd is supplying the drive current Ids to the light emitting device EL. The drive current Ids flows from the power supply line VL being at the high voltage Vdd to pass through the light emitting device EL to a cathode line through the driving transistor Trd.

Next, in the non-luminous period of the field, first, at timing T1, the power supply line VL is changed from the high voltage Vdd to the low potential Vss. Thus, the power supply line VL is discharged to Vss, and further the potential of the source S of the driving transistor Trd drops to Vss. Thereby, the anode potential (that is to say, the source potential of the driving transistor Trd) of the light emitting device EL becomes a reverse bias state, and thus the drive current stops to flow to put the light off. Also, the potential of the gate G drops together with the decrease in the potential of the source S of the driving transistor.

Next, at timing T2, the sampling transistor Tr1 becomes a conductive state by changing the scanning line WS from a low level to a high level. At this time, the signal line SL is at the reference voltage Vref. Thus, the potential of the gate G of the driving transistor Trd becomes the reference voltage Vref of the signal line SL through the conductive sampling transistor Tr1. At this time, the potential of the source S of the driving transistor Trd is the potential Vss, which is sufficiently lower than Vref. In this manner, the voltage Vgs across the gate G and the source S of the driving transistor Trd is initialized so as to become greater than the threshold voltage Vth of the driving transistor Trd. A period T1-T3, from timing T1 to timing T3, is a preparatory period for setting the voltage Vgs across the gate G and the source S of the driving transistor Trd to higher than Vth in advance.

After this, at timing T3, the power supply line VL changes from the low potential Vss to the high potential Vdd, and thus the potential of the source S of the driving transistor Trd starts to increase. After a while, when the voltage Vgs across the gate G and the source S of the driving transistor Trd becomes equal to the threshold voltage Vth, the current is cut off. In this manner, the voltage corresponding to the threshold voltage Vth of the driving transistor Trd is written into the holding capacitor Cs. This is the threshold-voltage correction operation. At this time, in order to cause the current to flow exclusively to the holding capacitor Cs, and to prevent flowing into the light emitting device, the cathode potential Vcath is set such that the light emitting device EL cuts off. The threshold-voltage correction operation completes at timing T4 while the potential of the signal line SL changes from Vref to Vsig. A period T3-T4, from timing T3 to timing T4, becomes the mobility correction period.

At timing T4, the signal line SL changes from the reference potential Vref to the signal potential Vsig. At this time, the sampling transistor Tr1 is still in a conductive state. Thus, the potential of the gate G of the driving transistor Trd becomes the signal potential Vsig. Here, the light emitting device EL becomes a cut-off state (high impedance state) at first, and thus the current flowing between the drain and the source of the driving transistor Trd exclusively flows to the holding capacitor Cs and the equivalent capacitor of the light emitting device EL, and charging is started. After this, until timing T5 when the sampling transistor Tr1 becomes OFF, the potential of the source S of the driving transistor Trd increases by ΔV. In this manner, the signal potential Vsig of the video signal is written into the holding capacitor Cs by adding the video signal Vsig to Vth. At the same time, the voltage ΔV for the mobility correction is subtracted from the voltage held in the holding capacitor Cs. Thus, a period T4-T5, from timing T4 to timing T5, becomes a signal write period/mobility correction period. In this manner, in the signal write period T4-T5, the writing of the signal potential Vsig and the adjusting of the amount of correction ΔV are performed at the same time. The higher Vsig is, the larger the current Ids supplied by the driving transistor Trd becomes, and thus the larger the absolute value of ΔV becomes. Accordingly, the mobility correction is performed in accordance with the luminance intensity level. When Vsig is assumed to be a constant, the higher the mobility μ of the driving transistor Trd is, the larger the absolute value of ΔV becomes. To put it another way, the higher the mobility μ is, the larger the amount of negative feedback ΔV to the holding capacitor Cs becomes. Thus, it is possible to eliminate the variations of the mobility μ for each pixel.

Finally, at timing T5, as described above, the scanning line WS changes to the low level, and thus sampling transistor Tr1 becomes an off state. Thereby, the gate G of the driving transistor Trd is cut off from the signal line SL. At the same time, the drain current Ids starts to flow to the light emitting device EL. Thus, the anode potential of the light emitting device EL increases in accordance with the drive current Ids. An increase in the anode potential of the light emitting device EL is nothing but an increase in the potential of the source S of the driving transistor Trd. When the potential of the source S of the driving transistor Trd increases, the potential of the gate G of the driving transistor Trd also increases together by the bootstrap operation of the holding capacitor Cs. The amount of increase in the gate potential becomes equal to the amount of increase in the source potential. Accordingly, the voltage Vgs across the gate G and the source S of the driving transistor Trd is held at a constant during the luminous period. The value of Vgs is produced by performing the correction of the threshold voltage Vth and the amount μ of the mobility on the signal potential Vsig.

Although the example of the related art described with reference to FIGS. 1 to 3 has a simple circuit configuration in which a pixel includes two transistors (a sampling transistor and a driving transistor), it is possible to provide a high-quality display apparatus including a threshold-voltage correction function and a mobility correction function. However, since the threshold-voltage correction function and the mobility correction function are achieved by a small number of devices, it is necessary to control the changing of the potentials of the power supply line VL and the signal line SL at complicated timing. Thus, the load on the drive section becomes heavy, causing a cost increase. In particular, the power source scanner 6, which changes the power supply line VL between Vdd and Vss, needs high current-drive ability, and thus a special driver IC is necessary. Also, since the power supply line VL supplies a drive current to each pixel, it becomes necessary to use a material having a low wiring resistance. Accordingly, it is necessary to form the power supply line VL by a different process from the case of the scanning line WS.

Figure 4:
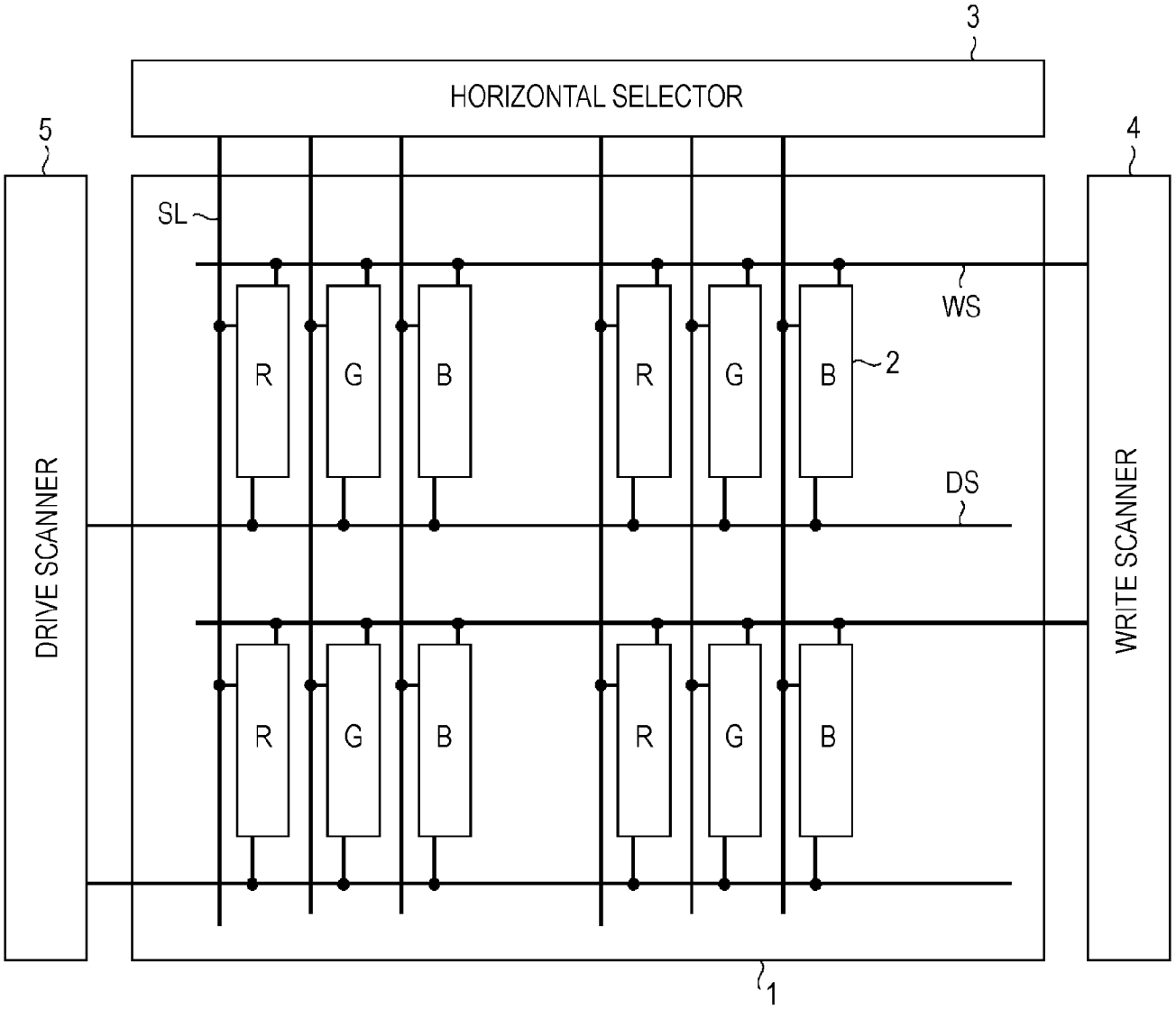
FIG. 4 is a block diagram illustrating an overall configuration of a display apparatus according to the present invention.

FIG. 4 is a block diagram illustrating an overall configuration of a display apparatus according to the present invention. In this display apparatus, the above-described shortcomings of the display apparatus, shown in FIG. 1, according to the related art are prevented. In addition, the power consumption of the panel is reduced by blocking a penetration current at the time of the prevention. In order to simplify understanding, the same reference numerals are given to the parts corresponding to those of the display apparatus, shown in FIG. 1, according to the related art. As shown in FIG. 4, the display apparatus basically includes a pixel array section 1 and a drive section driving the pixel array section 1. The pixel array section 1 includes a row of first scanning lines WS, a row of second scanning lines DS, a column of signal lines SL, and pixels 2, in a matrix, each of the pixels disposed at an intersection of each of the first scanning lines WS and each of the signal lines SL. In contrast, the drive section includes a write scanner 4, a drive scanner 5, and a horizontal selector 3. The write scanner 4 outputs a control signal to each of the first scanning lines WS to perform line progressive scanning on pixels 2 for each row. The drive scanner 5 also outputs a control signal to each of the second scanning lines DS to perform line progressive scanning on pixels 2 for each row. However, the write scanner 4 and the drive scanner 5 output control signals at different timing. The drive scanner 5 is disposed in the drive section in place of the power source scanner 6 used in the example of the related art. By eliminating the power source scanner, the power supply lines are also removed from the pixel array section 1. Instead, although not shown in the figure, a power source lines supplying a constant power potential Vdd is disposed in the pixel array section 1. At the same time, the horizontal selector 3 supplies the signal potential of the video signal and a reference voltage to a column of signal lines SL in accordance with the line progressive scanning of the scanners 4 and 5.

Figure 5:
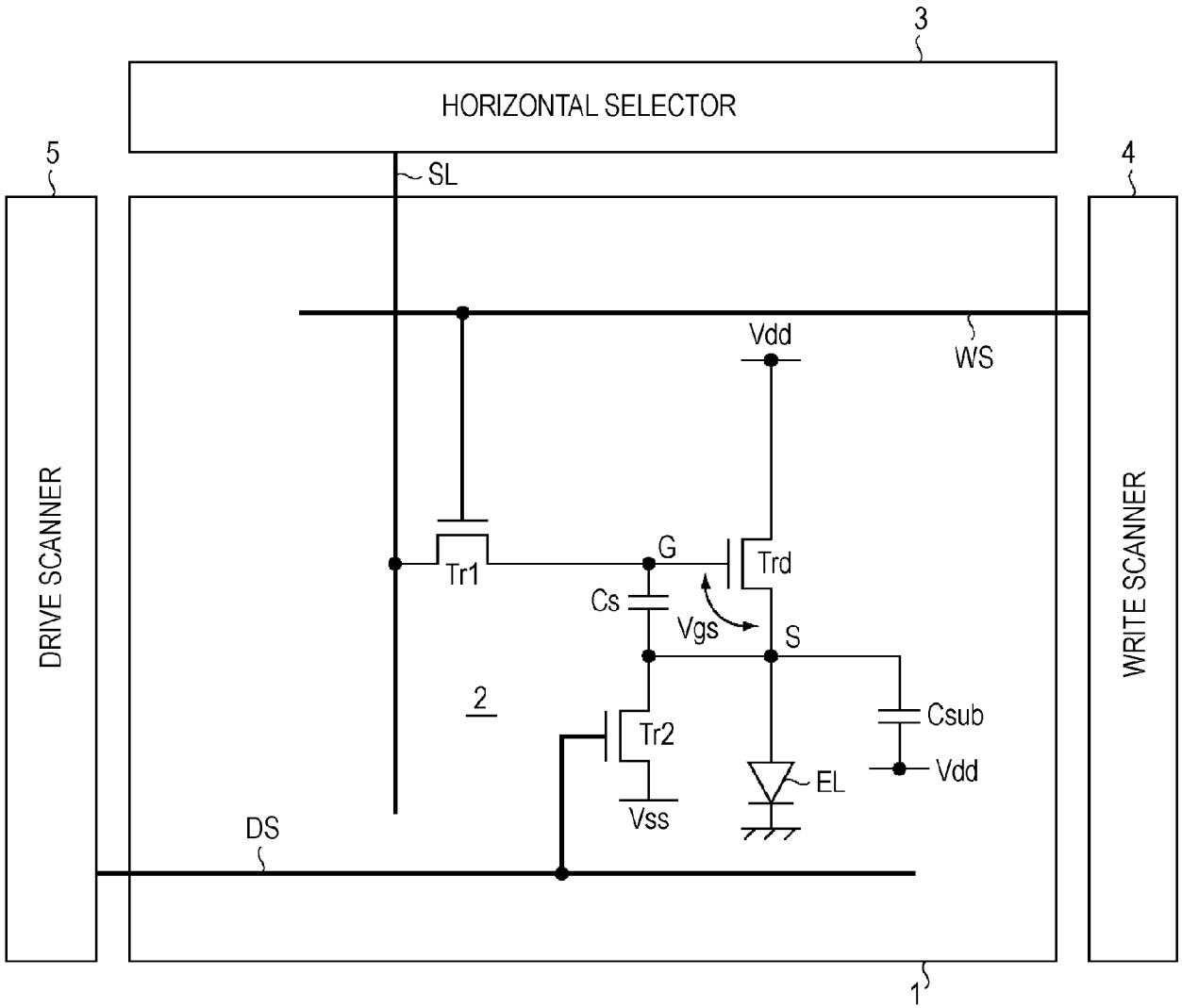
FIG. 5 is a circuit diagram illustrating a configuration of a pixel incorporated in the display apparatus, shown in FIG. 4, according to the present invention.

FIG. 5 is a circuit diagram illustrating a configuration of a pixel incorporated in the display apparatus shown in FIG. 4. As shown in the figure, the pixel 2 basically includes a light emitting device EL, a sampling transistor Tr1, a driving transistor Trd, a switching transistor Tr2, and a holding capacitor Cs. The sampling transistor Tr1 has a control terminal (gate) connected to the scanning line WS and a pair of current terminals (source and drain), one of the current terminals is connected to the corresponding signal line SL, and the other of the current terminals is connected to a control terminal (gate G) of the driving transistor Trd. The driving transistor Trd has a pair of current terminals (source and drain), one of the current terminals (drain) is connected to the power source line Vdd, and the other of the current terminals (source S) is connected to the anode of the light emitting device EL. The cathode of the light emitting device EL is connected to a predetermined cathode potential Vcath. The switching transistor Tr2 has a control terminal (gate) connected to the scanning line DS, and has a pair of current terminals (source and drain), one of the current terminals is connected to the fixed potential Vss, and the other of the current terminals is connected to the source S of the driving transistor Trd. One terminal of the holding capacitor Cs is connected to the control terminal (gate G) of the driving transistor Trd, and the other terminal is connected to the other current terminal (source S) of the driving transistor Trd. The other current terminal of the driving transistor Trd is the output current terminal to the light emitting device EL and the holding capacitor Cs. In this regard, in this pixel circuit 2, an auxiliary capacitor Csub is connected across the source S of the driving transistor Trd and the power source Vdd in order to assist the holding capacitor Cs.

In such a configuration, the write scanner 4 in the drive section supplies a control signal for controlling the opening and the closing of the sampling transistor Tr1 to the first scanning line WS. The drive scanner 5 outputs a control signal for controlling the opening and the closing of the switching transistor Tr2 to the second scanning line DS. The horizontal selector 3 supplies a video signal (input signal) changing between the signal potential Vsig and the reference voltage Vref to the signal line SL. In this manner, the potentials of the scanning lines WS and DS and the signal line SL vary in accordance with the line progressive scanning, but the power source line is fixed at Vdd. Also, the cathode potential Vcath and the fixed potential Vss are also constant.

Figure 6:
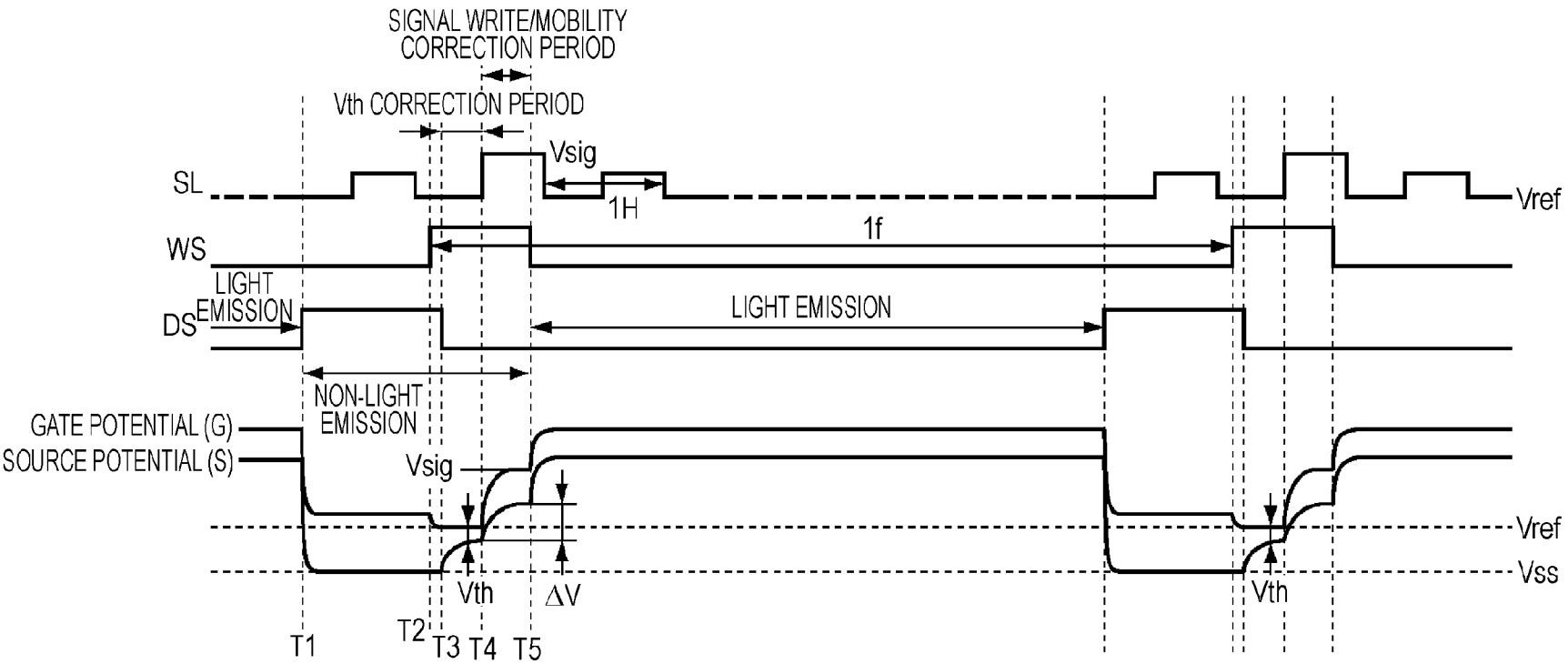
FIG. 6 is a timing chart to be used for explaining operations of the pixel circuit shown in FIG. 5.

FIG. 6 is a timing chart to be used for explaining operations of the display apparatus, shown in FIG. 5, according to the present invention. However, the timing chart of FIG. 6 is an example for reference, and shows the operation sequence before a measure for blocking a penetration current is taken. In this regard, in order to simplify understanding, the same notation as that used in the timing chart shown in FIG. 3 is employed. As shown in the figure, in the timing chart, the changes in the potentials of the scanning line WS, the scanning line DS, and the signal line SL are shown at the same timing on the same time axis. The sampling transistor Tr1 is an N-channel type, and is turned ON when the scanning line WS becomes a high level. The switching transistor Tr2 is also an N-channel type, and is turned ON when the scanning line DS becomes a high level. At the same time, the video signal supplied on the signal line SL changes between the signal potential Vsig and the reference voltage Vref in one horizontal cycle (1H). This timing chart shows the changes in the potentials of the gate G and the source S of the driving transistor Trd at the same timing on the same time axis with the changes in the potentials of the first scanning line WS, the second scanning line DS, and the signal line SL. The operation state of the driving transistor Trd is controlled in accordance with the potential difference Vgs across the gate G and the source S.

First, when the state moves into the non-luminous period of the field from the luminous period of the previous field, at timing T1, the scanning line DS is changed to a high level, and thus the switching transistor Tr2 is turned ON. Thereby, the potential of the source S of the driving transistor Trd is set to the fixed potential Vss. At this time, the fixed potential Vss is set to a value smaller than the sum of the threshold voltage Vthel and the cathode potential Vcath. That is to say, Vss is set to satisfy Vss<Vthel+Vcath. Accordingly, the light emitting device EL is in a reverse bias state, and thus the drive current Ids does not flow into the light emitting device EL. However, the output current Ids supplied from the driving transistor Trd flows into the fixed potential Vss through the source S. In this manner, when the state moves into the non-luminous period, a penetration current flows from the source potential Vdd to the state moves into fixed potential Vss.

Next, at timing T2, the sampling transistor Tr1 is turned ON in the state of the potential of the signal line SL being at Vref. Thereby, the gate G of the driving transistor Trd is set to the reference voltage Vref. Thus, the potential difference Vgs across the gate G and the source S of the driving transistor Trd becomes Vref−Vss. Here, Vgs is set to satisfy Vgs=Vref−Vss>Vth. IfVref−Vss is not greater than the threshold voltage Vth, it is not possible to successfully perform the subsequent threshold-voltage correction operation. However, since Vgs=Vref−Vss>Vth, the driving transistor Trd is in an ON state, and thus the drain current flows from the power source potential Vdd to the fixed potential Vss. In this manner, in spite of being in the non-luminous period, a penetration current, which does not contribute to light emission, flows from the power source potential Vdd to the fixed potential Vss in vain. However, this period is necessary in order to initialize the gate G and the source S of the driving transistor Trd in preparation for the correction operation on the threshold voltage.

After this, at timing T3, in the threshold-voltage correction period, the switching transistor Tr2 is turned OFF, and thus the source S of the driving transistor Trd is cut off from the fixed potential Vss. Here, as long as the potential of the source S (that is to say, the anode potential of the light emitting device) is lower than the sum of the cathode potential Vcath and the threshold voltage Vthel of the light emitting device EL, the light emitting device EL is still in a reverse bias state, and thus only a slight leak current flows. Accordingly, the current supplied from the power source line Vdd through the driving transistor Trd is mostly used for charging the holding capacitor Cs and the auxiliary capacitor Csub. In this manner, the holding capacitor Cs is charged, and thus the source potential of the driving transistor Trd increases with a lapse in time. After a certain time period, the source potential of the driving transistor Trd reaches the level of Vref−Vth, and thus Vgs becomes equal to Vth. At this point in time, the driving transistor Trd is in cutoff, and the voltage corresponding to Vth is written into the holding capacitor Cs disposed between the source S and the gate G of the driving transistor Trd. At the time of the completion of the threshold-voltage correction operation, the source voltage Vref−Vth is lower than the sum of the cathode potential Vcath and the threshold voltage Vthel of the light emitting device.

Next, at timing T4, the display apparatus proceeds to a write period/mobility correction period. At timing T4, the signal line SL is changed from the reference potential Vref to the signal potential Vsig. The signal potential Vsig has become the voltage in accordance with the grayscale. At this point in time, the sampling transistor Tr1 is ON, and thus the potential of the gate G of the driving transistor Trd becomes Vsig. Thereby, the driving transistor Trd becomes ON, and a current flows from the power-source line Vdd. Thus, the potential of the source S increases with time. At this point in time, the potential of the source S is still not greater than the sum of the threshold voltage Vthel of the light emitting device and the cathode potential Vcath. Accordingly, only a slight leak current flows through the light emitting device EL, and the current supplied from the driving transistor Trd is mostly used for charging the holding capacitor Cs and the auxiliary capacitor Csub. In the charging process, the potential of the source S increases as described above.

In this write period, the threshold-voltage correction operation of the driving transistor Trd has already been completed, and thus the current supplied from the driving transistor Trd reflects the mobility μ thereof. Specifically, if the mobility μ of the driving transistor Trd is high, the amount of current supplied by the driving transistor Trd becomes large, and thus the potential of the source S increases fast. On the contrary, if the mobility μ is small, the amount of current supplied by the driving transistor Trd is small, and thus the increase in the potential of the source S becomes small. In this manner, by negatively feeding back the output current of the driving transistor Trd to the holding capacitor Cs, the potential difference Vgs across the gate G and the source S of the driving transistor Trd reflects the mobility μ. After a passage of a certain period time, Vgs becomes the value having a completely corrected mobility μ. That is to say, in the write period, the mobility μ of the driving transistor Trd is corrected simultaneously by negatively feeding back the current output from the driving transistor Trd to the holding capacitor Cs.

Finally, at timing T5, in the luminous period of the field, the sampling transistor Tr1 is turned OFF, and the gate G of the driving transistor Trd is cut off from the signal line SL. Thereby, it becomes possible for the potential of the gate G to increase, and thus the potential of the source S increases together with the increase in the potential of the gate G while maintaining the value of the Vgs held in the holding capacitor Cs. Thus, the reverse bias state of the light emitting device EL is eliminated, and the driving transistor Trd causes the drain current Ids in accordance with Vgs to flow to the light emitting device EL. The potential of the source S increases until a current flows to the light emitting device EL, and the light emitting device EL emits light. Here, if the light emitting device EL emits light for a long time, the current/voltage characteristic of the device changes. Thus, the potential of the source S also changes. However, the voltage Vgs across the gate G and the source S of the driving transistor Trd is maintained at a constant value by the bootstrap operation, and thus the current flowing to the light emitting device EL does not change. Accordingly, even if the current/voltage characteristic of the light emitting device EL is deteriorated, a constant current Ids continues to flow constantly, and thus the luminance of the light emitting device EL will not change.

As described above, the display apparatus, shown in FIG. 5, according to the present invention can set the source S of the driving transistor Trd to the fixed potential Vss by adding switching transistor Tr2. Accordingly, it is not necessary to provide the power supply line VL as the example of the related art shown in FIG. 2, to change the potential thereof between Vdd and Vss, and thus to provide the special power source scanner 6. It is possible to perform ON/OFF control on the switching transistor Tr2 by a normal drive scanner 5 in the same manner as the write scanner 4. In the display apparatus, shown in FIG. 5, according to the present invention, it is necessary to turn the switching transistor Tr2 ON during the non-luminous period in relation to the operation inevitably. If no measure is taken, as described by the timing chart in FIG. 6, a penetration current flows from the power-source potential Vdd to the fixed potential Vss in spite of the non-luminous period by the switching transistor Tr2 being turned ON. Thus, there is a problem in that the power is consumed in vain. In a raster screen, a luminance of a screen is sometimes adjusted in accordance with the ratio of the luminous period to the non-luminous period for each filed. In such a luminance adjustment method, it is preferable that a current should not flow through a pixel in a non-luminous state. However, by the operation sequence shown in FIG. 6, a current is consumed even in a non-luminous state, and thus it is difficult to reduce power consumption.

Figure 7:
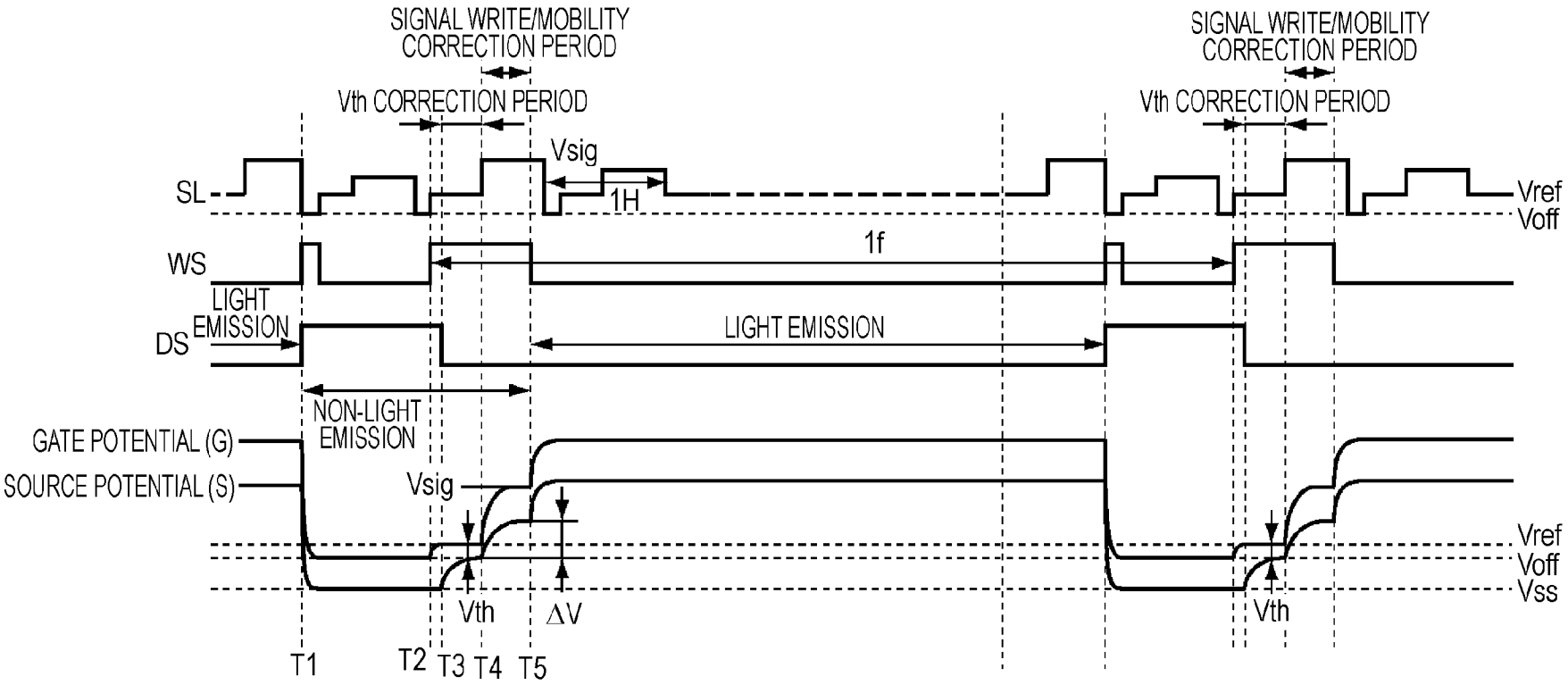
FIG. 7 is anther timing chart to be used for explaining operations of the pixel shown in FIG. 5.

FIG. 7 is another timing chart to be used for explaining operations of display apparatus, shown in FIG. 5, according to the present invention. In order to simplify understanding, the same notation as that used in the timing chart shown in FIG. 6 is employed. The operation sequence shown by the timing chart of FIG. 7 makes it possible to block a penetration current, thereby allowing the power consumption reduction of the panel. The different points from the timing chart are that first, the signal line SL changes among three potentials, namely a signal potential Vsig, a reference voltage Vref, and an off voltage Voff in one horizontal period 1H. The signal potential Vsig is set higher than the reference voltage Vref, and the off voltage Voff is set lower than Vref. Secondly, two control pulses are supplied to the scanning line WS in one field (1*f*). The first control pulse is output at the time of changing from a luminous period of the previous field to a non-luminous period of the field. The next control pulse is supplied at the time when the threshold-voltage correction operation and the signal write operation/the mobility correction operation are performed in the non-luminous period of that field.

First, at timing T1, the control signal DS is changed from a low level to a high level, and thus the switching transistor Tr2 is turned ON. Thereby, the source S of the driving transistor Trd is connected to the fixed potential Vss. When the source potential (that is to say, the anode potential of the light emitting device EL) of the driving transistor Trd becomes Vss, the light emitting device EL goes into a reverse bias state, and the light is turned off. Thereby, the pixel goes into the non-luminous period of the field from the luminous period of the previous field. At this time, a control pulse having a small time width is applied to the scanning line WS, and the sampling transistor Tr1 is turned ON only for a short time period. At this timing, the signal line SL is at the off potential Voff. Accordingly, the off potential Voff is written into the gate G of the driving transistor Trd. Thus, at the point in time of timing T1, the voltage Vgs across the gate G and the source S of the driving transistor Trd becomes Voff−Vss. Here, the voltage is set such that Vgs=Voff−Vss becomes less than the Vth of the driving transistor Trd. Thus, the driving transistor Trd is in cutoff at the beginning of the non-luminous period of the driving transistor Trd. Accordingly, in the non-luminous period after that, the driving transistor Trd maintains the cutoff state before starting the Vth correction operation. Thus, a penetration current does not flow from the power-source potential Vdd to the fixed potential Vss. In this manner, it is possible to block the penetration current in most of the non-luminous period, thereby allowing the power consumption reduction of the panel. As described above, the sampling transistor Tr1 is turned ON when the switching transistor Tr2 is turned ON, gets an off voltage from the signal line SL to apply the voltage to the gate G of the driving transistor Trd to turn OFF this transistor, thereby preventing the penetration current from flowing from the power-source potential Vdd to the fixed potential Vss. However, it is not necessary to correctly match the ON timing of the switching transistor Tr2 and the OFF timing of driving transistor. There arises no problem even if both of the timings are misaligned a little as long as the timings are matched so as to suppress a useless penetration current.

After this, at timing T2, the control signal pulse is applied to the scanning line WS again, and thus the sampling transistor Tr1 is turned ON. At this timing, the signal line SL is at the reference potential Vref. The reference voltage Vref is written in the gate G of the driving transistor Trd. Thus, the potential difference Vgs across the gate G and the source S of the driving transistor Trd becomes Vofs−Vss. Here, Vgs is set to satisfy Vgs=Vofs−Vss>Vth. If Vofs−Vss is not greater than the threshold voltage Vth, it is not possible to successfully perform the subsequent threshold-voltage correction operation. However, since Vgs=Vofs−Vss>Vth, the driving transistor Trd becomes an ON state at this point in time, and thus a penetration current flows from the power source potential Vdd to the fixed potential Vss. However, at timing T3, almost without a delay after timing T2, the switching transistor Tr2 is turned off, and thus it is possible to disregard the penetration current that flows at this time.

After this, at timing T3, in the threshold-voltage correction period, the switching transistor Tr2 is turned OFF, and thus the source S of the driving transistor Trd is cut off from the fixed potential Vss. Here, as long as the potential of the source S (that is to say, the anode potential of the light emitting device) is lower than the sum of the cathode potential Vcath and the threshold voltage Vthel of the light emitting device EL, the light emitting device EL is still in a reverse bias state, and thus only a slight leak current flows. Accordingly, the current supplied from the power source line Vdd through the driving transistor Trd is mostly used for charging the holding capacitor Cs and the auxiliary capacitor Csub. In this manner, the holding capacitor Cs is charged, and thus the source potential of the driving transistor Trd increases with a lapse in time. After a certain time period, the source potential of the driving transistor Trd reaches the level of Vref−Vth, and thus Vgs becomes equal to Vth. At this point in time, the driving transistor Trd is in cutoff, and the voltage corresponding to Vth is written into the holding capacitor Cs disposed between the source S and the gate G of the driving transistor Trd. At the time of the completion of the threshold-voltage correction operation, the source voltage Vref−Vth is lower than the sum of the cathode potential Vcath and the threshold voltage Vthel of the light emitting device.

Next, at timing T4, the display apparatus proceeds to a write period/mobility correction period. At timing T4, the signal line SL is changed from the reference potential Vref to the signal potential Vsig. The signal potential Vsig has become the voltage in accordance with the grayscale. At this point in time, the sampling transistor Tr1 is ON, and thus the potential of the gate G of the driving transistor Trd becomes Vsig. Thereby, the driving transistor Trd becomes ON, and a current flows from the power-source line Vdd. Thus, the potential of the source S increases with time. At this point in time, the potential of the source S is still not greater than the sum of the threshold voltage Vthel of the light emitting device and the cathode potential Vcath. Accordingly, only a slight leak current flows through the light emitting device EL, and the current supplied from the driving transistor Trd is mostly used for charging the holding capacitor Cs and the auxiliary capacitor Csub. In the charging process, the potential of the source S increases as described above.

In this write period, the threshold-voltage correction operation of the driving transistor Trd has already been completed, and thus the current supplied from the driving transistor Trd reflects the mobility μ thereof. Specifically, if the mobility μ of the driving transistor Trd is high, the amount of current supplied by the driving transistor Trd becomes large, and thus the potential of the source S increases fast. On the contrary, if the mobility μ is small, the amount of current supplied by the driving transistor Trd is small, and thus the increase in the potential of the source S becomes small. In this manner, by negatively feeding back the output current of the driving transistor Trd to the holding capacitor Cs, the potential difference Vgs across the gate G and the source S of the driving transistor Trd reflects the mobility μ. After a passage of a certain period time, Vgs becomes the value having a completely corrected mobility μ. That is to say, in the write period, the mobility μ of the driving transistor Trd is corrected simultaneously by negatively feeding back the current output from the driving transistor Trd to the holding capacitor Cs.

Finally, at timing T5, in the luminous period of the field, the sampling transistor Tr1 is turned OFF, and the gate G of the driving transistor Trd is cut off from the signal line SL. Thereby, it becomes possible for the potential of the gate G to increase, and thus the potential of the source S increases together with the increase in the potential of the gate G while maintaining the value of the Vgs held in the holding capacitor Cs. Thus, the reverse bias state of the light emitting device EL is eliminated, and the driving transistor Trd causes the drain current Ids in accordance with Vgs to flow to the light emitting device EL. The potential of the source S increases until a current flows to the light emitting device EL, and the light emitting device EL emits light. Here, if the light emitting device EL emits light for a long time, the current/voltage characteristic of the device changes. Thus, the potential of the source S also changes. However, the voltage Vgs across the gate G and the source S of the driving transistor Trd is maintained at a constant value by the bootstrap operation, and thus the current flowing to the light emitting device EL does not change. Accordingly, even if the current/voltage characteristic of the light emitting device EL is deteriorated, a constant current Ids continues to flow constantly, and thus the luminance of the light emitting device EL will not change.

Figure 8:
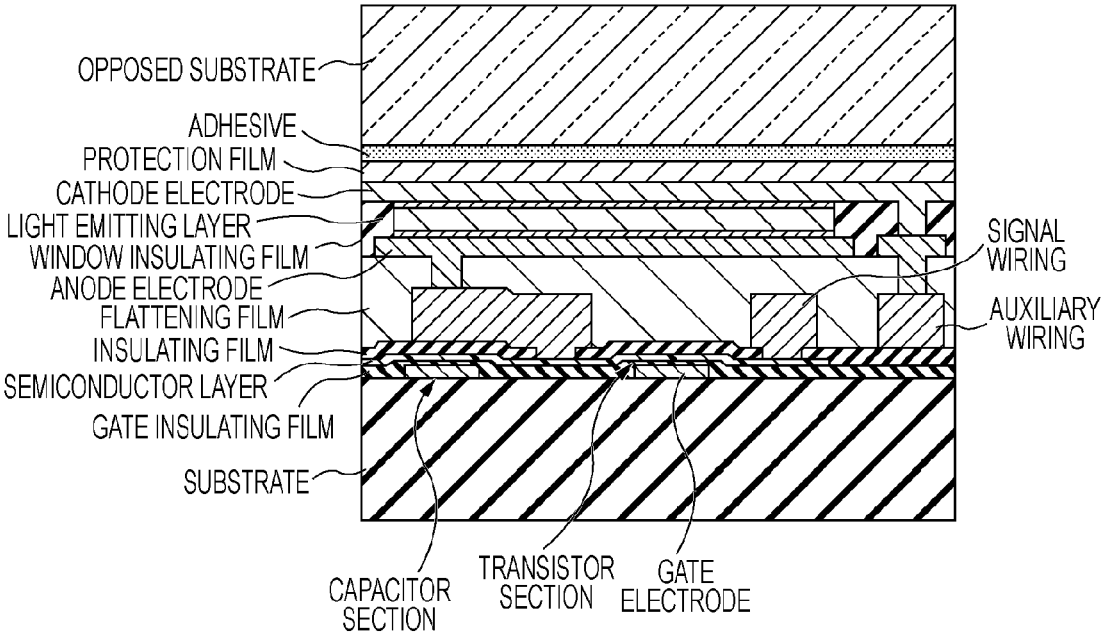
FIG. 8 is a sectional view illustrating a device configuration of a display apparatus according to the present invention.

A display apparatus according to the present invention has a thin-film device configuration as shown in FIG. 8. This figure schematically shows a sectional structure of a pixel formed on an insulating substrate. As shown in the figure, the pixel includes a transistor section (one TFT is shown for example in the figure) including a plurality of thin-film transistors, a capacitor section, such as a holding capacitor, and a light emitting section, such as an organic EL device, etc. The transistor section and the capacitor section are formed on a substrate by a TFT process, and a light emitting section, such as an organic EL device, etc., is laminated thereon. A transparent opposed substrate is attached by adhesive thereon to form a flat panel.

Figure 9:
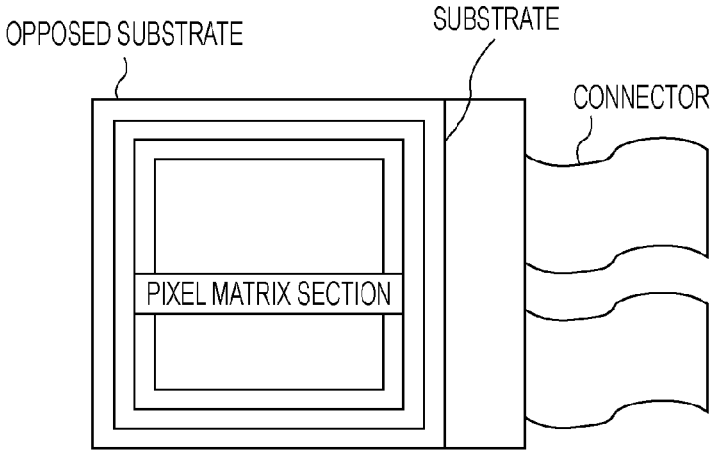
FIG. 9 is a plan view illustrating a module configuration of a display apparatus according to the present invention.

A display apparatus according to the present invention includes a flat modular-shaped display as shown in FIG. 9. For example, a display array section formed by integrating pixels, in a matrix, each of the pixels including an organic EL device, a thin-film transistor, a thin-film capacitor, etc., is disposed on an insulating substrate, adhesive is provided so as to surround the pixel array section (pixel matrix section), and an opposed substrate, such as a glass, etc., is attached to produce a display module. A color filter, a protection film, a light blocking film, etc., may be disposed as necessary on this transparent opposed substrate. The display module may be provided with, for example, an FPC (Flexible Print Circuit) as a connector for externally inputting and outputting a signal, etc., to and from the pixel array section.

A display apparatus according to the present invention, described above, is a flat panel in shape. It is possible to apply the display apparatus to the displays of electronic systems in various fields, for example, a digital camera, a notebook-sized personal computer, a mobile phone, a video camera, and the like in order to display images or videos that are input into the electronic systems or generated by the electronic systems. In the following, examples of the electronic system to which such a display apparatus is applied are shown.

Figure 10:
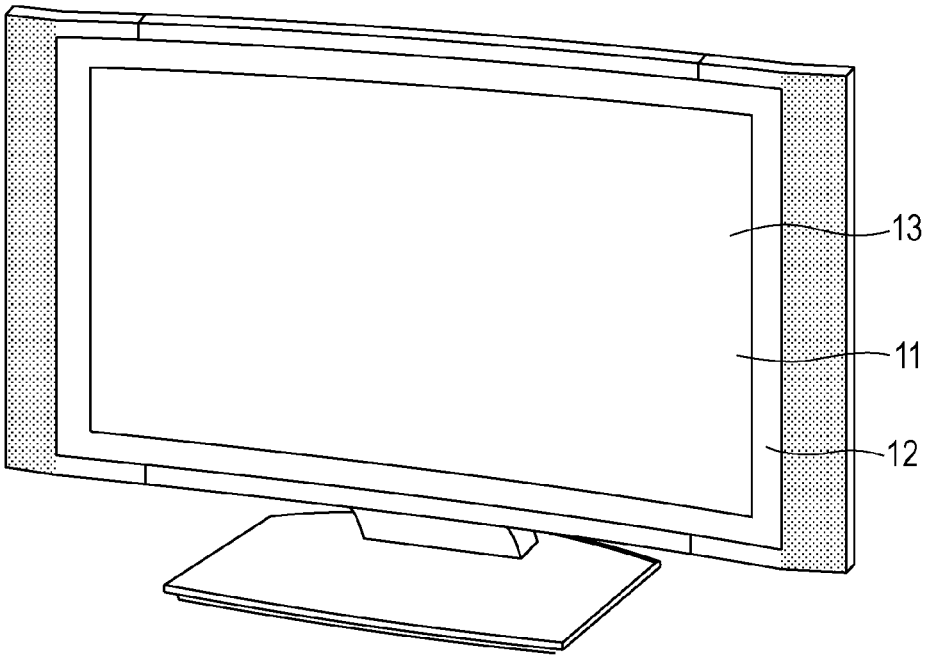
FIG. 10 is a perspective view illustrating a television set provided with a display apparatus according to the present invention.

FIG. 10 is a television to which the present invention is applied. The television includes a video display screen 11 including a front panel 12, a filter glass 13, etc., and is produced by using a display apparatus of the present invention as the video display screen 11.

Figure 11:
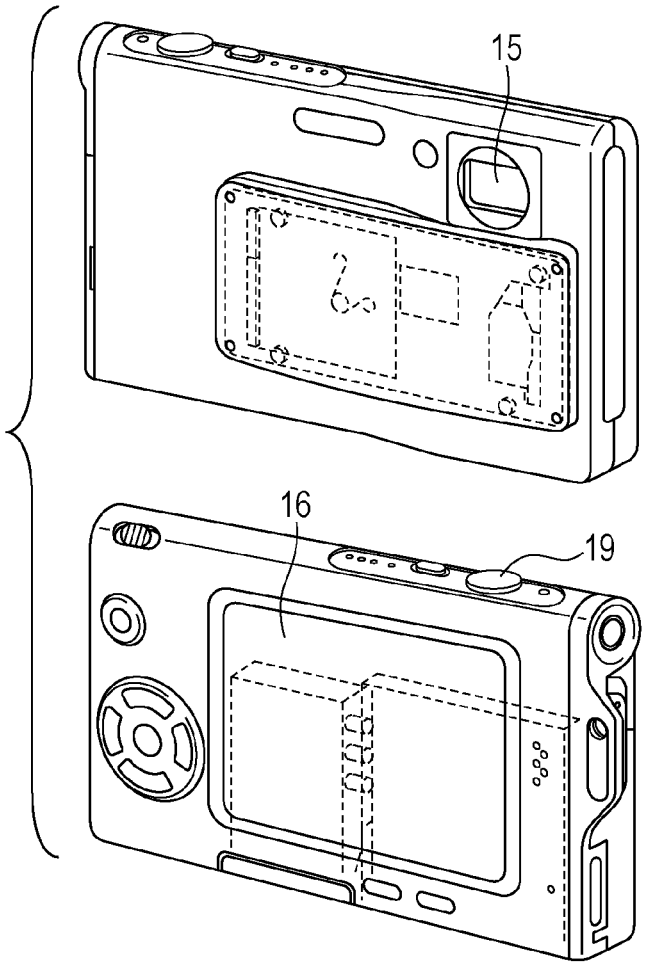
FIG. 11 is a perspective view illustrating a digital still camera provided with a display apparatus according to the present invention.

FIG. 11 illustrates a digital camera to which the present invention is applied. The upper part is a front view, and the lower part is a rear view. This digital camera includes a capturing lens, a light emitting section 15 for a flash, a display section 16, a control switch, a menu switch, a shutter 19, etc., and is produced by using a display apparatus of the present invention as the display section 16.

Figure 12:
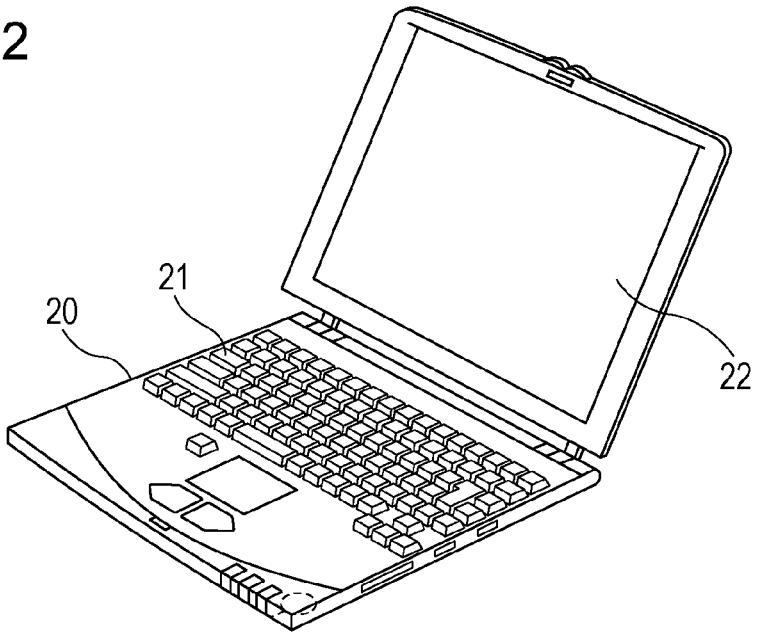
FIG. 12 is a perspective view illustrating a notebook-sized personal computer provided with a display apparatus according to the present invention.

FIG. 12 illustrates a notebook-sized personal computer to which the present invention is applied. A main unit 20 includes a keyboard 21 which is operated when characters, etc., are input, the cover of the main unit includes a display section 22 displaying images, and is produced by using a display apparatus of the present invention as the display section 22.

Figure 13:
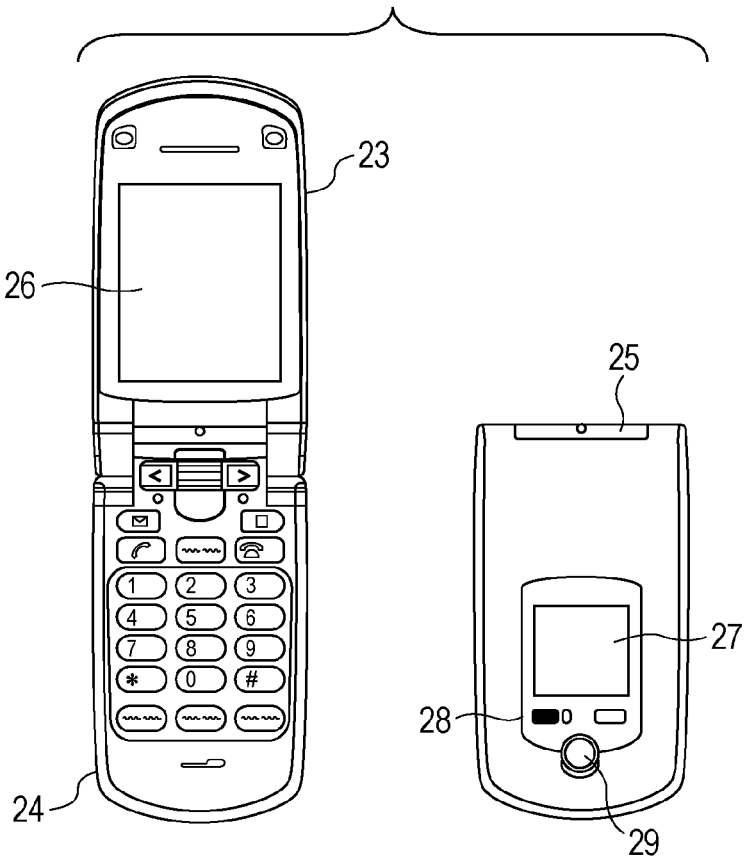
FIG. 13 is a schematic diagram illustrating a mobile terminal apparatus including a display apparatus according to the present invention.

FIG. 13 illustrates a mobile terminal apparatus to which the present invention is applied. The left part shows an open state, and the right part shows a closed state. This mobile terminal apparatus includes an upper case 23, a lower case 24, a connecting part (here, a hinge part) 25, a display 26, a sub-display 27, a picture light 28, a camera 29, etc., and is produced by using a display apparatus of the present invention as the display 26 and the sub-display 27.

Figure 14:
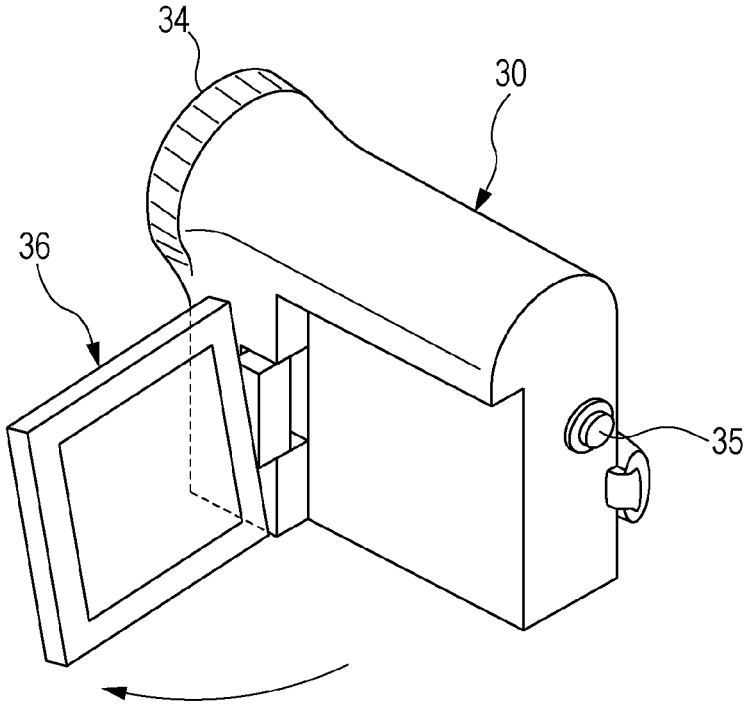
FIG. 14 is a perspective view illustrating a video camera including a display apparatus according to the present invention.

FIG. 14 illustrates a video camera to which the present invention is applied. The video camera includes a main unit 30, a lens 34 for capturing an object on the side surface facing front, a start/stop switch 35 at shooting time, a monitor 36, etc., and is produced by using a display apparatus of the present invention as the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus, comprising:

a pixel array section including first scanning lines, second scanning lines, signal lines, and pixels in a matrix; and a drive section configured to output a first control signal and a second control signal to the first scanning lines and the second scanning lines, respectively, at least one of the pixels comprising a light emitting device, a first transistor, a second transistor, a third transistor, and a holding capacitor, the first transistor having a control terminal connected to one of the first scanning lines, a first current terminal connected to one of the signal lines, and a second current terminal connected to a control terminal of the second transistor, the second transistor having a first current terminal connected to a power source and a second current terminal connected to the light emitting device, the third transistor having a control terminal connected to one of the second scanning lines, a first current terminal connected to a fixed potential, and a second current terminal connected to the second current terminal of the second transistor, and the second transistor being configured to supply drive current to the light emitting device to change the light emitting device to a luminous state, wherein the third transistor becomes ON in accordance with the second control signal supplied from the one of the second scanning lines to apply the fixed potential to an anode electrode of the light emitting device, the first transistor becomes ON in accordance with the first control signal supplied from the one of the first scanning lines to apply the predetermined potential to the control terminal of the second transistor, and the fixed potential is lower than a potential applied to a cathode electrode.

2. The display apparatus according to claim 1, wherein the first transistor becomes ON in accordance with the first control signal supplied from the one of the first scanning lines after the third transistor becomes ON.

3. The display apparatus according to claim 1, wherein the first transistor is configured to set a potential difference between first and second terminals of the holding capacitor to be higher than a threshold voltage of the driving transistor, and subsequently, the first transistor is configured to turn off the third transistor, and to charge the holding capacitor until a driving capacitor is cut off, and to hold a voltage corresponding to the threshold voltage in the holding capacitor.

4. The display apparatus according to claim 1, wherein the second transistor is configured to negatively feedback drive current flowing through the second transistor to the holding capacitor for a predetermined correction time period in a state where a signal potential is applied to the control terminal of the second transistor, and to apply a correction corresponding to a mobility of the second transistor to the signal potential held by the holding capacitor.

5. An electronic apparatus comprising the display apparatus according to claim 1.

6. The electronic apparatus according to claim 5, wherein the first transistor becomes ON in accordance with the first control signal supplied from the one of the first scanning lines after the third transistor becomes ON.

7. The electronic apparatus according to claim 5, wherein the first transistor is configured to set a potential difference between first and second terminals of the holding capacitor to be higher than a threshold voltage of the driving transistor, and subsequently, the first transistor is configured to turn off the third transistor, and to charge the holding capacitor until a driving capacitor is cut off, and to hold a voltage corresponding to the threshold voltage in the holding capacitor.

8. The electronic apparatus according to claim 5, wherein the second transistor is configured to negatively feedback drive current flowing through the second transistor to the holding capacitor for a predetermined correction time period in a state where a signal potential is applied to the control terminal of the second transistor, and to apply a correction corresponding to a mobility of the second transistor to the signal potential held by the holding capacitor.

* * * * *